US008366157B2

(12) United States Patent
Helisten

(10) Patent No.: US 8,366,157 B2
(45) Date of Patent: Feb. 5, 2013

(54) DOOR LOCK

(75) Inventor: Mika Helisten, Ylämylly (FI)

(73) Assignee: Abloy Oy, Joensuu (FI)

( * ) Notice: Subject to any disclaimer, the term of this patent is extended or adjusted under 35 U.S.C. 154(b) by 563 days.

(21) Appl. No.: 12/597,712

(22) PCT Filed: Apr. 9, 2008

(86) PCT No.: PCT/FI2008/050170

§ 371 (c)(1),
(2), (4) Date: Oct. 26, 2009

(87) PCT Pub. No.: WO2008/132272

PCT Pub. Date: Nov. 6, 2008

(65) Prior Publication Data

US 2010/0045050 A1 Feb. 25, 2010

(30) Foreign Application Priority Data

Apr. 27, 2007 (FI) ..... 20075295

(51) Int. Cl.
*E05B 65/10* (2006.01)

(52) U.S. Cl. ..... 292/92; 292/137; 292/DIG. 65

(58) Field of Classification Search ..... 292/92, 292/137, 157–159, DIG. 65; 70/107, 109, 70/92, 116

See application file for complete search history.

(56) References Cited

U.S. PATENT DOCUMENTS

| | | | | |
|---|---|---|---|---|
| 1,377,061 | A | 5/1921 | Deeg | |
| 5,216,909 | A | 6/1993 | Armoogam | |
| 5,373,716 | A * | 12/1994 | MacNeil et al. | 70/109 |
| 7,354,081 | B2 * | 4/2008 | Kondratuk | 292/169 |
| 7,836,737 | B2 * | 11/2010 | Lin | 70/116 |
| 7,926,315 | B2 * | 4/2011 | Poletti | 70/107 |
| 2004/0061339 | A1 | 4/2004 | Lemettinen | |
| 2008/0211239 | A1 * | 9/2008 | Keller | 292/164 |

FOREIGN PATENT DOCUMENTS

| | | | |
|---|---|---|---|
| EP | 0779403 | A1 | 6/1997 |
| EP | 1160398 | A1 | 12/2001 |
| EP | 1355028A | A | 10/2003 |
| FI | FI871601 | A | 10/1988 |
| FR | 2726026 | A | 4/1996 |
| GB | 2260568 | A | 4/1993 |
| GB | 2290107 | A | 12/1995 |
| RU | 2191877 | C2 | 10/2002 |

(Continued)

OTHER PUBLICATIONS

Decision on Grant for RU 2009143847 (with English translation).

(Continued)

*Primary Examiner* — Carlos Lugo
*Assistant Examiner* — Mark Williams
(74) *Attorney, Agent, or Firm* — Muncy, Geissler, Olds & Lowe, PLLC

(57) ABSTRACT

This invention relates to a door lock comprising a lock body (3) fitted with a front plate and a bolt (4). The transfer of external force to the locking piece (5) in the lock body is reduced. The reduction of external force is arranged in two stages of transmission. At the first stage of transmission, the transmitted force is reduced using a wedge part (10) that is in force transmission contact with a lever (11). The second stage of transmission constitutes the lever.

15 Claims, 4 Drawing Sheets

FOREIGN PATENT DOCUMENTS

Figure 1:
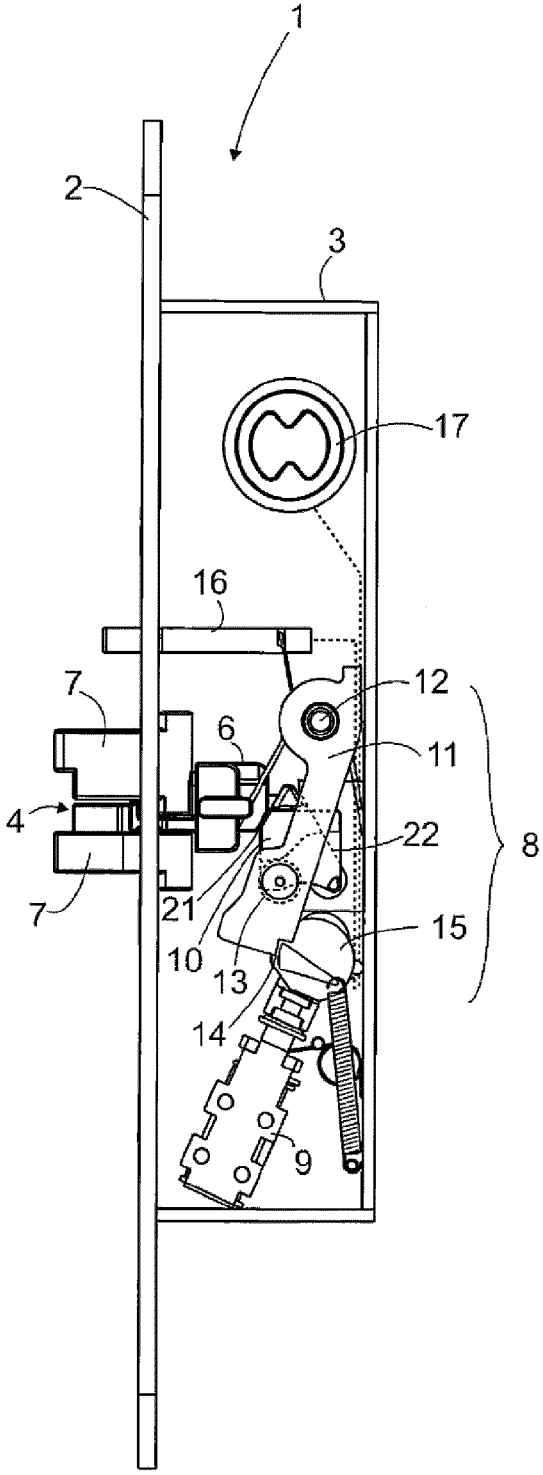

| | | | |
|---|---|---|---|
| WO | 9823830 | A1 | 6/1998 |
| WO | WO03016660 | A1 | 2/2003 |
| WO | WO2007069938 | A | 6/2007 |

OTHER PUBLICATIONS

Roeland Henkes, International Search Report for PCT/FI2008/050170, Sep. 29, 2008.

Marko Keranen, Finnish Office action and Search Report for FI 20075295, Feb. 29, 2008.

Kazakevich Aleksandr Vil Jamov, "Lock", European Patent Office, The Hague, NL, to achieve reduced power consumption, Mar. 20, 2007.

* cited by examiner

FIG. 3
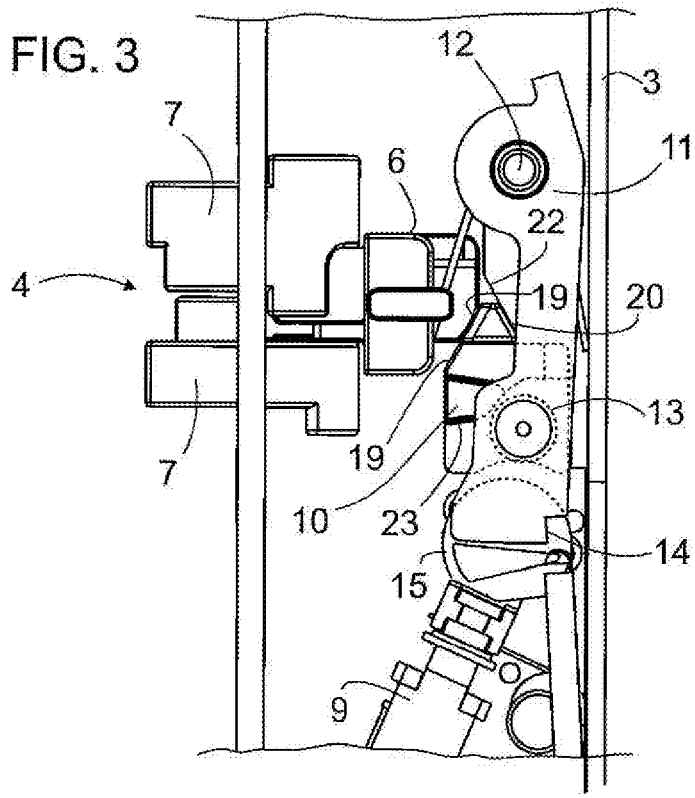
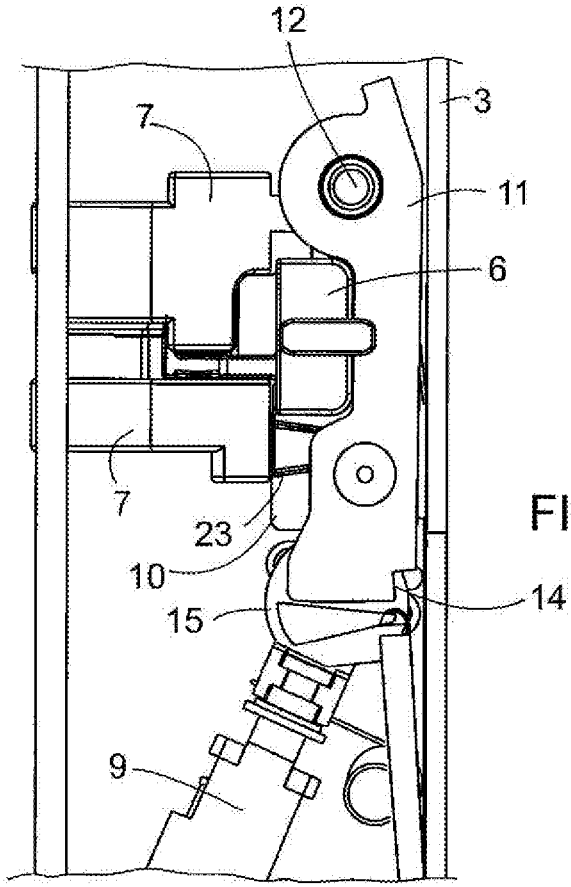
FIG. 4

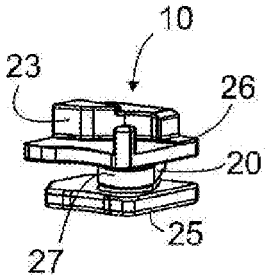
FIG. 5A
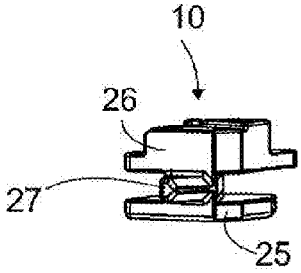
FIG. 5B
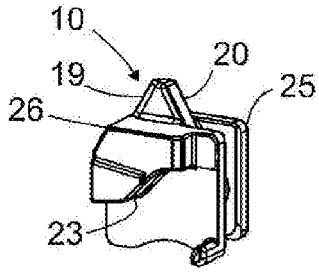
FIG. 5C
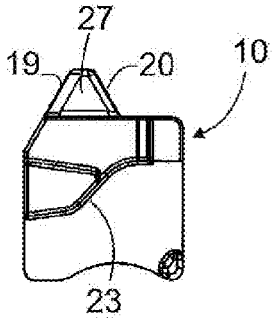
FIG. 5D
FIG. 6
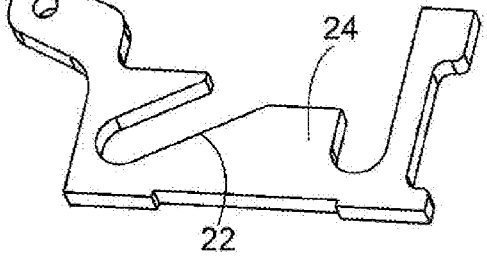
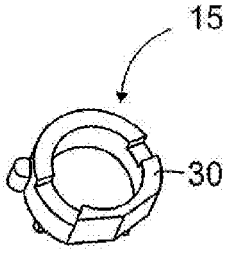
FIG. 7A
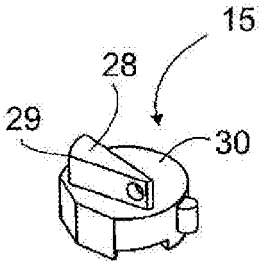
FIG. 7B
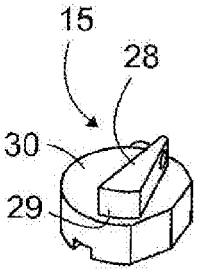
FIG. 7C

DOOR LOCK

This is a national stage application filed under 35 USC 371 based on International Application No. PCT/FI2008/050170 filed Apr. 9, 2008, and claims priority under 35 USC 119 of Finnish Patent Application No. 20075295, filed Apr. 27, 2007.

FIELD OF TECHNOLOGY

This invention relates to a door lock comprising a lock body fitted with a front plate and a dual-action bolt. The bolt can be moved with reciprocal linear motion between a withdrawn position and a locking position protruding out from the lock body.

PRIOR ART

An electrically controlled door lock often uses a solenoid or other actuator to control deadbolting means in the lock as to lock the bolt in the deadbolting position. In the deadbolting position, the bolt is out; in other words, protruding out from the lock body. The solenoid is also used to release the deadbolting means from the deadbolting position, which allows the bolt to move into the lock body to the withdrawn position.

In prior art solutions, the solenoid or other actuator is functionally linked to a deadbolting piece that can be moved so that it locks the bolt in the deadbolting position. In a typical implementation, the deadbolting piece is linked to the solenoid shaft, and a spring is used to arrange the shaft to protrude outwards from the solenoid. When the solenoid is de-energised, the spring holds the deadbolting piece in the deadbolting position, and when the solenoid is energised, the solenoid tries to move the deadbolting piece out of the deadbolting position against the spring force.

The spring must be sufficiently strong to hold the locking piece securely in the deadbolting position. This, in turn, means that the solenoid must be sufficiently powerful to be able to move the locking piece against the spring force.

When the door is closed and the lock is in the locked state, seals between the door and the door frame tend to press the lock bolt against the striker plate in the door frame. In case of a dual-action bolt, the bolt also tends to push into the lock body; in other words, it pushes against the deadbolting piece controlled by the solenoid. These external forces counteract the force of the solenoid or other actuator when the solenoid is operated to move the locking piece out of the locking position.

Thus the solenoid or other actuator must be sufficiently powerful to be able to control the deadbolting piece. If the solenoid/actuator is too weak in power, this will cause disruptions in lock operation such as unwanted locked states.

Exit doors are often also equipped with a mechanical actuator such as a bar that must be able to open the door. The bar is called an emergency exit bar. The emergency exit bar is used by pressing it down to release the locked state of the lock. Being an actuator, the bar is also pushed towards the door, particularly in an emergency. This may impose a great force between the striker plate and the bolt. Therefore the force conveyed from the actuator to the lock can be quite great, which may cause the deadbolting parts of the lock to jam and result in unreliable operation.

SHORT DESCRIPTION OF INVENTION

The objective of the invention is to reduce the electrical energy needed by a lock body to control the lock and, simultaneously, use a lower-power actuator such as a solenoid. It is desired that operation of the lock is reliable also when using mechanical actuators such as an emergency exit bar. The objectives will be achieved as described in the independent claim. The dependent claims describe various embodiments of the lock according to the invention.

The transfer of external force to the locking piece is reduced, which reduces the power requirement for the electric actuator. The impact of external mechanical force on the operation of the locking piece is smaller. The reduction of external force is arranged in two stages of transmission. At the first stage of transmission, the transmitted force is reduced using a wedge part that is in force transmission contact with a lever. The second stage of transmission consists of different leverages at different points of the lever. The lever has a locking surface that can be arranged to contact the locking piece.

LIST OF FIGURES

Figure 2:
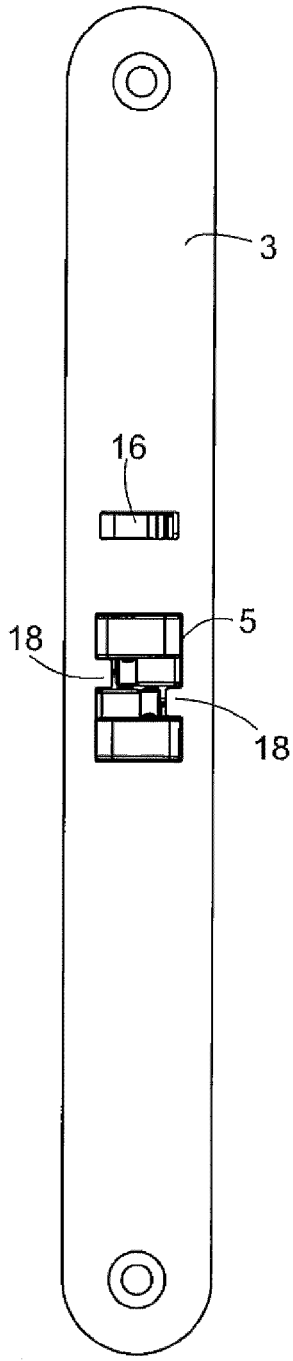
Figure 8:
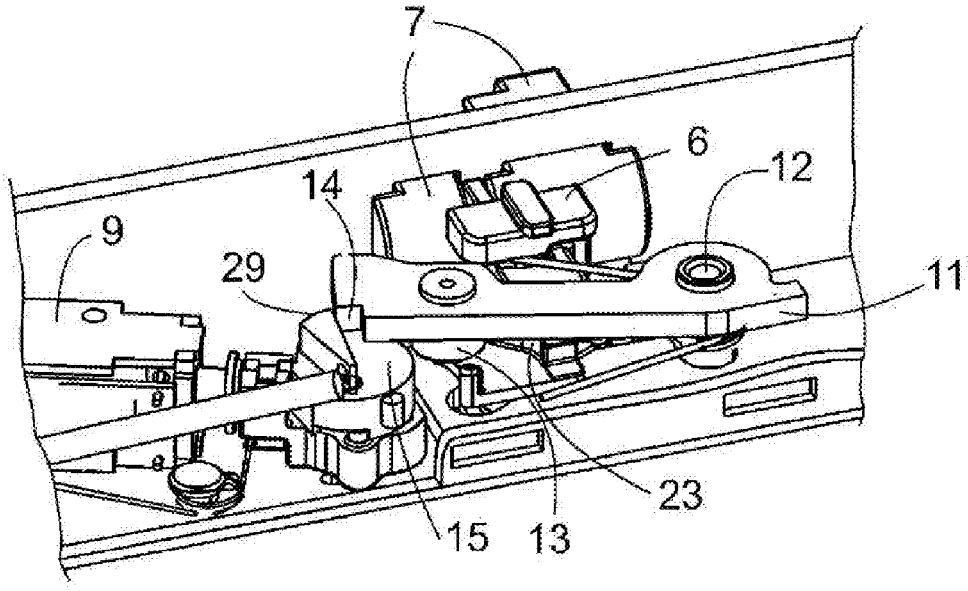
Figure 9:
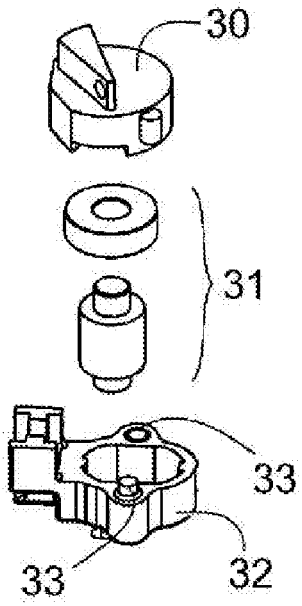

In the following, the invention is described in more detail by reference to the enclosed drawings, where FIG. 1 illustrates an example of a door lock according to the invention with the bolt out, FIG. 2 illustrates an example of a door lock according to the invention viewed from the front side of the front plate, FIG. 3 illustrates an example of a door lock according to the invention with the bolt moving in, FIG. 4 illustrates an example of a door lock according to the invention with the bolt fully in, FIGS. 5A-5D illustrate an example of a wedge according to the invention, FIG. 6 illustrates an example of a door lock wedge support piece according to the invention, FIGS. 7A-7C illustrate an example of a locking piece, FIG. 8 illustrates an example of a locking piece and a solenoid shaft plunger element in a lock body, and FIG. 9 illustrates the locking piece and the solenoid shaft plunger element.

DESCRIPTION OF THE INVENTION

FIG. 1 illustrates an example of a door lock 1 according to the invention. The door lock comprises a lock body 3 fitted with a front plate 2; the lock body has a dual-action bolt 4 that can be moved with reciprocal linear motion between a withdrawn position and a locking position protruding out from the lock body through the bolt opening 5 (FIG. 2) in the front plate 2. The bolt 4 comprises a body part 6, and in the embodiment of FIG. 1, two bolt pieces 7. The bolt 4 is spring-loaded towards said protruding position. The door lock 1 further comprises deadbolting means 8 that can be moved to a deadbolting position in which they prevent the dual-action bolt from being moved from the protruding position to the withdrawn position in the lock body 3. The lock of this embodiment also comprises a solenoid 9 for controlling the deadbolting means.

The door lock usually also comprises other control means for controlling the deadbolting means. The lock may have an auxiliary bolt 16 and/or control spindle means 17. The auxiliary bolt prevents the bolt from moving to deadbolting when the door is open but allows it when the door is closed. The control spindle means 17 comprises, for example, a cylinder body, a handle and/or a knob. The connection from the control spindle means and auxiliary bolt to the locking piece 15 within the deadbolting means is simply marked with dashed lines. Thus in the embodiment of FIG. 1, the locking piece can be controlled with the solenoid 9, the auxiliary bolt 16 and the control spindle means.

The lock may also be arranged to receive control from an emergency exit bar. In this case very great external forces may be conveyed to the deadbolting means of the lock. This will happen, for example, if the emergency exit bar is simultaneously pushed, imposing great force between the striker plate in the door frame and the lock bolt. This force tends to push the dual-action bolt intensively into the lock body, which may jam the deadbolting means.

FIG. 2 illustrates an embodiment of a lock according to the invention viewed from the front side of the front plate. It can be seen from the figure that in this embodiment, the edge of the bolt opening 5 has projections 18 that are required for the bolt pieces 7 used in the embodiment. Some other type of dual-action bolt can certainly also be used in a lock according to the invention.

The deadbolting means comprise a wedge 10 between the body part 6 of the bolt and the lock body 3. The wedge is arranged to move transversely to the linear path of the bolt. The deadbolting means also comprise a locking piece 15 and a lever 11 comprising a support point 12, a support surface 13 and a locking surface 14. The lever 11 is pivotably supported on the lock body 3 at the support point 12. The support surface 13 is arranged to cooperate with the wedge 10.

The support surface 13 and locking surface 14 can be turned with the lever in relation to the support point 12 between the lever's outward turning position towards the front plate and inward turning position towards the back edge of the lock body.

The locking surface 14 is farther away from the support point 12 than the support surface 13. The lever 11 is spring-loaded towards the outward turning position. The locking piece 15 can be moved against the locking surface 14 to lock the lever and wedge in a deadbolting position, in which deadbolting position the lever 11 is in the outward turning position and the support surface 13 is against the wedge 10, and the wedge is wedged between the bolt body 6 and the lock body 3.

FIG. 1 illustrates the lock with the bolt 4 out and the deadbolting means 8 in deadbolting state. In FIG. 3, the bolt 4 has moved somewhat inside the lock body 3. In FIG. 4, the bolt is fully inside the lock body; in other words, in the withdrawn position. In FIGS. 3 and 4, the deadbolting piece 15 is driven to the open position in which it does not prevent the other deadbolting parts from moving into the withdrawn position.

FIGS. 5A-5D illustrate an embodiment of the wedge 10. The wedge 10 comprises a first 19 and a second 20 bevelled surface transversal to the linear path of the bolt. The angle between the bevelled surfaces opens towards the lever support surface 13. The bolt body 6 comprises a first counter surface 21 for the first bevelled surface, and the lock body comprises a second counter surface 22 for the second bevelled surface.

When the deadbolting piece 15 is driven to the open position and the door is being opened, the bolt 4 tends to push inwards under pressure from the striker plate. When using a dual-action bolt, one of the bolt pieces 7 turns in the same direction as the other bolt piece, making the bevelled surfaces of the bolt pieces congruent. The striker plate in the door frame presses against this congruent bevelled surface while simultaneously pushing the bolt into the lock body. It can be seen in FIG. 3 how one of the bolt pieces has turned and the wedge is being pushed away from the path of the bolt. This is caused by the first counter surface 21 pushing the first bevelled surface 19 of the wedge. At this time, the wedge slides along the second counter surface 22 in the lock body. The second bevelled surface 20 of the wedge is against the second counter surface 22.

While the wedge slides away from the path of the bolt, the wedge presses the support surface 13 of the lever, and the lever 11 tends to turn in relation to the support point 12. A support counter surface 23 for the support surface of the lever is arranged in the wedge.

The external force that pushes the bolt 4 inwards into the lock body is divided to different components in the wedge and in the lever. The transfer of external force to the locking surface 14 of the lever can be kept minor. The wedge and its connections with the other parts constitute the first stage of transmission at which the external force imposed on the bolt body 6 can be reduced by a factor of 0.6 to 0.8 at the support surface 13 of the lever. The rest of the external force is directed through the second bevelled surface 20 to the lock body 3. The second stage of transmission consists of different leverages at different points of the lever 11. Due to the external force, the lever tends to turn in relation to the support point 12 towards the back part of the lock body. Because the external force component at the support surface 13 of the lever is closer to the support point 12 of the lever than the locking surface 14 of the lever, less force is required at the locking surface to hold the lever 11 in the desired position compared to the force component at the support surface 13. The second stage of transmission reduces the external force by a factor of 0.2 to 0.4 at the locking surface 14. Both stages of transmission combined reduce the external force by a factor of 0.12 to 0.32. The transmission factors depend on the implementation of the embodiment according to the invention.

It can be seen in FIG. 3 that the location of the connection between the wedge 10 and the lever 11 in relation to the lever support point 12 depends on the positions of the wedge and lever. The cooperation between the lever support surface 13 and the wedge 10 is arranged so that at a certain position after the wedge has moved away from the path of the bolt, the effect of the support surface 13 counteracting the movement of the wedge is reduced. This is achieved so that the support counter surface 23 of the wedge is a curved surface and that the lever support surface is arranged to always be perpendicular to the support counter surface 23. This way the distance between the force component vector affecting the lever support surface 13 and the lever support point 12 depends on the position of the lever. The distance of the force component vector affects the magnitude of the transmission factor at the second stage of transmission. In practice this is evident in that the force counteracting the inward movement of the bolt is initially great when the bolt is out. The counteracting force is clearly reduced when the bolt has moved somewhat into the lock body. FIG. 3 illustrates such a situation in which the lever support surface 13 has moved past the curve in the support counter surface 23, due to which the transmission factor has changed.

At a certain position, when the bolt 4 pushes into the lock body, the wedge 10 moves completely away from the linear path of the bolt, allowing the bolt to move to the withdrawn position without obstruction from the first counter surface 19. At that time the bolt is allowed to move to the withdrawn position illustrated in FIG. 4. When the force pushing the bolt inwards ceases to have effect, the spring pushes the bolt out of the lock body.

Because the stages of transmission substantially reduce the effect of external force on the lever locking surface 14—that is, at the locking piece 15—it is more reliable to drive the locking piece to the desired position compared to a situation in which the external force would affect the locking piece as such. The solenoid or other actuator is not required to be too powerful, which means that the lock body may include a smaller and less expensive solenoid or other actuator. The lock body may also be smaller, making it easy to install the lock in tight quarters. Therefore the electric current required by the solenoid/actuator may also be smaller.

In the present embodiment, the support surface 13 of the lever is a projection, and the support counter surface 23 of the wedge is a cut-out. The support surface is preferably a circular surface. A projection with a circular surface can be conveniently created so that it is a roller attached to the lever 11 in a rotating fashion and its outer surface is said circular surface. The cut-out 23 in the wedge is preferably shaped so that the circular surface 13 is in contact with the wedge regardless of the position of the lever 11. It is certainly also possible that the connection between the lever and wedge is formed in some other way. The rotating roller may be attached to the wedge, and the curved support surface may be in the lever.

It is preferable to locate the lever locking surface 12 at the end of the lever, which provides the maximum length of leverage in relation to the lever support point 12. The locking surface can be, for example, a shear surface. It is preferable that the locking surface is radial to the shaft formed by the support 12.

It is preferable to create the second counter surface 22 in the lock body using a wedge support piece 24. The wedge support piece is attached to the lock body. The second counter surface 22 can also be formed directly in the lock body but the use of a wedge support piece is preferred for ease of manufacture. Depending on other parts of the lock, the wedge support piece can be shaped in different ways. FIG. 6 illustrates an embodiment of the wedge support piece 24. The embodiment of the wedge in FIGS. 5A-5C comprises a base part 25 that settles on the opposite side of the wedge support piece 24 in relation to the top part 26 comprising the support counter surface. The intermediate part 27, which comprises the first 19 and second 20 bevelled surface, connects the base part and the top part. The second bevelled surface 20 settles against the second counter surface 22.

FIGS. 7A-7C illustrate an embodiment of the locking piece 15. The locking piece comprises a plate 28, the side 29 of which can be arranged against the locking surface. In this embodiment, the locking piece comprises a roller 30 pivotably supported on the lock body, which contains said plate. The side is preferably curved. Of course, a more conventional locking piece that is directly connected to the solenoid shaft can be used in a lock according to the invention.

FIG. 8 illustrates the positions of the parts of the locking means in relation to each other. The figure shows how the wedge 10 is against the body 3 and how the roller of the lever with its support surface 13 is in the cut-out of the wedge against the support counter surface 23. FIG. 9 illustrates the bearing 31 of the roller 30 used as the locking piece, as well as the solenoid shaft plunger element 32. The plunger element of this embodiment comprises two screws 33, either one of which is arranged so that the solenoid is able to use it to turn the roller 30 in relation to the axis formed by the bearing with linear motion of the solenoid shaft.

Even though the lock in the example described above is fitted with a solenoid, it can be replaced with some other actuator such as an electric motor, piezoelectric motor or smart metal actuator. The smart metal actuator can be, for example, a so-called MSM (Magnetically Controlled Shape Memory) device based on a controlled magnetic field. The magnetic field can be controlled electrically. Another option is that a lock according to the invention has no electric actuator at all. An emergency exit bar can be connected to a lock according to the invention. Because the deadbolting means reduce the effect of external force before the locking piece, the lock is reliable even if the force conveyed to the lock due to the operation of the emergency exit bar was great.

As can be noted, an embodiment according to the invention can be achieved through many different solutions. It is thus evident that the invention is not limited to the examples mentioned in this text.

Therefore any inventive embodiment can be implemented within the scope of the inventive idea.

The invention claimed is:

1. A door lock comprising a lock body (3) fitted with a front plate (2); the lock body has a power actuator, and a bolt (4) that can be moved with reciprocal linear motion between a withdrawn position and a locking position protruding out from the lock body through a bolt opening (5) in the front plate (2), said bolt comprising a body part (6) and being spring-loaded towards said protruding position, and said door lock further comprising deadbolting means (8) that can be moved to a deadbolting position in which they prevent the bolt from being moved from the protruding position to the withdrawn position in the lock body (3), characterised in that the deadbolting means (8) comprise a wedge (10) between the body part (6) of the bolt and the lock body (3), said wedge being arranged to move transversely to the linear path of the bolt, moving between the withdrawn position and the locking position, and a lever (11) comprising a support point (12), a support surface (13) and a locking surface (14), said lever being pivotably supported on the lock body at the support point (12), said support surface (13) being arranged to cooperate with the wedge, said support surface and locking surface being turnable in relation to the support point between an outward turning position of the lever towards the front plate and an inward turning position of the lever towards the back edge of the lock body, while the locking surface (14) is farther away from the support point (12) than the support surface (13), said lever being spring-loaded towards the outward turning position, and a locking piece (15) that can be moved against the locking surface (14) to lock the lever and wedge in a deadbolting position, in which deadbolting position the lever (11) is in the outward turning position and the support surface (13) is against the wedge (10), and the wedge is wedged between the bolt body (6) and the lock body (3), the wedge (10) comprising a first (19) and a second (20) bevelled surface transversal to the linear path of the bolt, the angle between said bevelled surfaces opening towards the lever support surface (13), said bolt body (6) comprising a first counter surface (21) for the first bevelled surface, and the lock body (3) comprising a second counter surface (22) for the second bevelled surface, said wedge (10) being arranged so that at a certain position between the outward turning position and the inward turning position of the lever (11) the first bevelled surface of the wedge fails to be against the first counter surface of the bolt and the wedge is away from the linear path of the bolt (4), allowing the bolt to move to the withdrawn position without obstruction from the first counter surface (19).

2. A door lock according to claim 1, characterised in that the wedge (10) comprises a support counter surface (23) for the lever support surface (13), the cooperation between the lever support surface (13) and the support counter surface (23) is arranged by shapes of said surfaces so that at a certain position after the wedge has moved away from the path of the bolt (4), the effect of the support surface counteracting the movement of the wedge is reduced.

3. A door lock according to claim 2, characterised in that the support surface (13) is a projection and the support counter surface (23) is a cut-out.

4. A door lock according to claim 3, characterised in that the support surface (13) is a circular surface.

5. A door lock according to claim 4, characterised in that the circular surface (13) is in contact with the wedge regardless of the position of the lever (11).

6. A door lock according to claim 5, characterised in that the projection (13) is a roller attached to the lever (11) in a rotating fashion and its outer surface is said circular surface (13).

7. A door lock according to claim 1, characterised in that the locking surface (14) is at the end of the lever (11).

8. A door lock according to claim 7, characterised in that the locking surface is a cut-out.

9. A door lock according to claim 1, characterised in that the locking surface (14) is radial to the shaft formed by the support (12).

10. A door lock according to claim 1, characterised in that the locking piece (15) comprises a plate (28), the side (29) of which can be arranged against the locking surface (14).

11. A door lock according to claim 10, characterised in that the locking piece comprises a roller (30) pivotably supported on the lock body, which contains said plate.

12. A door lock according to claim 10, characterised in that the side (29) is curved.

13. A door lock according to claim 1, characterised in that the lock body (3) comprises a wedge support piece (24), the support piece comprising said second counter surface (22).

14. A door lock according to claim 1, characterised in that the lock body comprises a solenoid (9) or other actuator for controlling the deadbolting means.

15. A door lock according to claim 1, characterised in that an emergency exit bar is functionally linked to the lock body.

* * * * *